United States Patent [19]

Trenkler et al.

[11] Patent Number: 4,599,771

[45] Date of Patent: Jul. 15, 1986

[54] METHOD OF MAKING A STIFFENED COMPOSITE METAL PANEL

[75] Inventors: George Trenkler, East Providence, R.I.; Richard Delagi, Sharon, Mass.; Charles Britton, S. Easton, Mass.; Robert J. Schwensfeir, Jr., Attleboro, Mass.

[73] Assignee: Texas Instruments Incorporated, Dallas, Tex.

[21] Appl. No.: 703,782

[22] Filed: Feb. 21, 1985

[51] Int. Cl.[4] ..... B23P 17/00

[52] U.S. Cl. ..... 29/155 R; 29/157.3 V; 29/418; 29/455 R; 228/157; 228/181

[58] Field of Search ..... 29/455 LM, 157.3 V, 29/418, 155 R, 455 R; 228/118, 181, 182, 193, 157

[56] References Cited

U.S. PATENT DOCUMENTS

| | | | |
|---|---|---|---|
| 3,067,492 | 12/1962 | Johnson | 29/455 LM UX |
| 3,164,894 | 1/1965 | Johnson et al. | 29/412 |
| 3,205,563 | 9/1965 | Pauls et al. | 29/157.3 V |
| 3,297,082 | 1/1967 | Tranel et al. | 165/170 |
| 3,834,000 | 9/1974 | Miller | 29/157.3 V X |

FOREIGN PATENT DOCUMENTS

| | | | |
|---|---|---|---|
| 696743 | 10/1964 | Canada | 228/118 |
| 1191345 | 10/1959 | France . | |

*Primary Examiner*—Charlie T. Moon

*Attorney, Agent, or Firm*—James P. McAndrews; John A. Haug; Melvin Sharp

[57] ABSTRACT

A stiffened composite metal panel is made by providing a layer of metal with spaced grooves of a depth less than the thickness of the metal layer for defining separable strips of the layer and, after arranging stripes of bond-preventing material between limited portions of the respective separable strips and a second metal layer, the metal layers are passed between pressure bonding rolls with reduction in the thickness of the layer materials to metallurgically bond a portion of each separable strip to the second metal layer to form a composite metal panel while leaving a portion of each separable strip free of such bonding at the location of the bond-preventing stripe. The separable strips are then broken apart along the grooves and folded away from the second metal layer to form precisely located stiffening ribs in the composite panel.

3 Claims, 8 Drawing Figures

METHOD OF MAKING A STIFFENED COMPOSITE METAL PANEL

BACKGROUND OF THE INVENTION

The invention relates to a method for making a composite metal panel and relates more particularly to a method for making such a panel having precisely located stiffening ribs.

Composite metal panels to be used as structural members or the like in various types of equipment have been provided with selectively stiffened sections in a variety of ways involving a preliminary step of metallurgically bonding a plurality of metal layers together to form a composite metal panel and a subsequent step of deforming at least one of the metal layers to form stiffening sections in the panel. Typically however the conventional methods for making such panels have tended to be inconvenient to carry out or have been subject to deficiencies in precisely locating stiffened sections in the panels relative to each other, in providing stiffened portions of the panel with desired uniform and predetermined strength characteristics, or in introducing stress or weakening factors in carrying out one or more of the process steps. For example in some methods where stiffening ribs are formed by inflating sections of a composite metal panel either with a fluid introduced between layers of the composite under pressure or with a gas developed between the layers by heat-decomposing of inflating material in situ between the layers, there is a tendency for the ribs to be thin in section or to be subject to localized necking down as they are formed by the inflation. Such ribs also typically require elaborate heat treating for achieving desired strength levels after forming. Similarly, in other known methods in which stiffening ribs are formed by folding up individually bonded strip materials or by slitting and folding up partially bonded layer materials, the processes tend to be cumbersome, it is difficult to locate the plurality of ribs in precisely predetermined relation to each other, and the forming steps tend to result in weakening of bonds previously provided in the panels.

SUMMARY OF THE INVENTION

It is an object of this invention to provide a novel and improved method for making a stiffened composite metal panel; to provide an improved method for providing such a stiffened composite metal panel having a plurality of stiffening ribs disposed in precisely predetermined relation to each other; to provide such a method which is convenient and economical to carry out; and to provide such a method which is particularly adapted for providing stiffened composite metal panels in repetitive manufacture at low cost with consistently reproducible properties.

Briefly described the novel and improved method of this invention provides a plurality or relatively narrow grooves in spaced, side-by-side, preferably parallel relation to each other in a first layer of metal, the grooves having a selected depth less than the thickness of that metal layer for defining separable strips of the metal layer. A plurality of stripes of bond-preventing material are arranged between the first metal layer and a second layer of metal to extend along the grooves so that the stripes of the bond-preventing material are disposed between the second metal layer and selected limited portions of the respective separable strips of the first metal layer. The metal layers are passed between pressure bonding rolls and are pressed together with reduction in the thickness thereof for metallurgically bonding each of the separable strips of the first metal layer to the second metal layer to form a composite metal panel while leaving a portion of each separable strip extending along a groove in the first metal layer free of such metallurgical bonds. The separable strips of the first metal layer are then broken apart and separated from each other along the respective grooves and the unbonded portions of the strips are folded up for forming precisely located stiffening ribs in the composite metal panel. In preferred embodiments of the invention, the grooves are provided in the first metal layer by profile rolling, machining or in other conventional manner and the separable strips of the first metal layer are broken apart and separated from each other after bonding in any conventional manner as by introducing fluid under pressure between the metal layers of the composite metal panel at the location of the stripes of bond-preventing material, by utilizing bond-preventing materials which are heat-decomposable to form inflating gases and by heating said materials to form such gases in situ in a composite metal panel at the locations of the bond-preventing stripes, or by inserting camming means or the like between the metal layers of the composite metal panel at the locations of the bond-preventing stripes.

In one preferred embodiment of the invention, the distal edges of the stiffening ribs are folded over to form flanges on the distal edges of the ribs and an additional panel layer is brazed or otherwise secured to the flanges. If desired, the stiffening ribs have different heights to support the additional panel layer so it extends obliquely relative to the second metal layer to which the ribs are metallurgically bonded. In one preferred embodiment, the first metal layer comprises a composite metal laminate material having a surface layer of a brazing alloy metallurgically bonded to a layer of a base metal and the brazing alloy layer is arranged to be disposed on outer surfaces of said flanges to facilitate securing of the additional panel layer to the flanges by brazing means. In one preferred embodiment, an additional group of stripes of bond-preventing material are disposed between a third metal layer and the above-noted first metal layer before the metal layers are passed between the pressure bonding rolls, the additional stripes also being arranged to extend parallel to the noted grooves and being disposed between the third metal layer and selected limited portions of the respective separable strips of the first metal layer partially overlapping the bond-preventing strips between the first and second layers of the panel. The three metal layers are then passed between the pressure bonding rolls with reduction in the thickness thereof for metallurgically bonding each of the separable strips of the first metal layer to both the second and third metal layers while leaving a portion of each strip on each side of the strip extending along an edge of the strip free of such metallurgical bonds. The separable strips of the first metal layer are then broken apart and separated from each other along the grooves by inflating or the like and the unbonded portions of the strips are folded up for forming a two-sided composite metal panel haivng said strips extending between the two panel sides as stiffening ribs in the panel.

DESCRIPTION OF THE DRAWINGS

Other objects, advantages and details of the novel and improved method of this invention appear in the following detailed description of preferred embodiments of the invention, the detailed description referring to the drawings in which.

DESCRIPTION OF THE PREFERRED EMBODIMENTS

Figure 1:
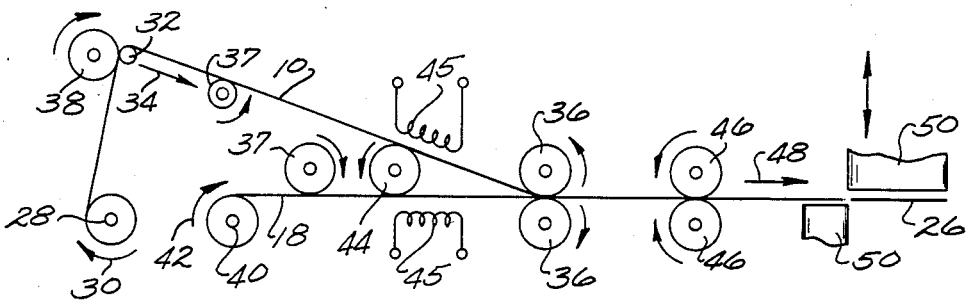
FIG. 1 is a schematic side elevation view of apparatus utilized in carrying out one preferred embodiment of the method of this invention.
Figure 2:
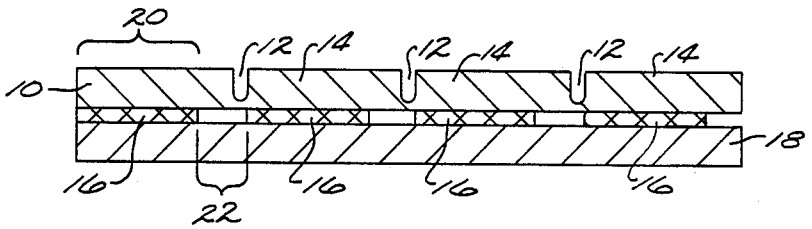
FIG. 2 is a diagrammatic section view through the metal layers utilized in forming the composite metal panel as the metal layers are initially brought together in accordance with a step of the method illustrated in FIG. 1.

Referring to the drawings, 10 in FIGS. 1 and 2 indicates a first metal layer having a plurality of relatively narrow grooves 12 formed in selectively spaced, side-by-side parallel relation to each other in the metal layer extending along the length of the layer, each groove having a depth less than the thickness of the metal layer for defining separable strips 14 of the first metal layer. A plurality of stripes 16 of bond-preventing material are arranged between the first metal layer 10 and a second layer of metal 18 so the stripes extend parallel to the grooves 12 in so that a stripe 16 of the bond-preventing material extends between the second layer 18 and a selected limited first portion 20 of each of the separable strips 14 while leaving an area between the second metal layer and a second portion 22 of each of the separable strips 14 free of the bond-preventing material. The two metal layers are pressed together with reduction in the thickness thereof for metallurgically bonding each of the separable strips 14 to the second metal layer 18 as is diagrammatically indicated at 24 in FIG. 3 for forming a composite metal panel 26 while leaving the first portions 20 of each strip free of such bonds. The bonded, separable strips 14 are then broken apart along the grooves 12 and the unbonded, first portions 20 of the strips 14 are folded away from the second metal layer 18 to form stiffening ribs 14*a* in the composite metal panel.

Figure 3:
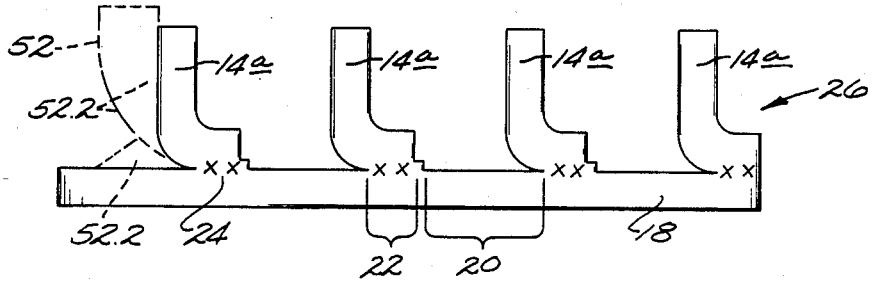
FIG. 3 is an end elevation view of the composite metal panel resulting from the method of this invention as illustrated in FIG. 1.

Preferably for example, the layer 10 is formed of steel or aluminum material or the like and is advanced from a supply reel 28 as indicated by arrow 30 to pass over a guide roll 32 and to advance as indicated by arrow 34 toward a pair of pressure bonding rolls 36. Milling means or other conventional groove forming means or the like are arranged to form the spaced grooves 12 in the metal layer 14 in any conventional manner as the metal layer is advanced toward the bonding rolls 36 as is diagrammatically illustrated at 38 in FIG. 1. The second metal layer 18 preferably of a corresponding metal material is advanced from a supply reel 40 toward the pressure bonding rolls 36 as indicated by the arrow 42 and facing surfaces of the layers 10 and 18 are preferably cleaned by mechanical means or the like such as the wire brushing means diagrammatically indicated at 37 as the metal layer is advanced toward the bonding rolls 36. Preferably, multiple spaced stripes of the bond-preventing material 16 are deposited on the metal layer 18 by screen printing means, pattern transfer means or roll-transfer means or the like as is diagrammatically illustrated at 44 in FIG. 1 as the metal layer 18 is advanced toward the bonding rolls 36 to be initially brought together with the metal layer 10 as the layers are advanced between the pressure bonding rolls 36. If desired, the metal layers are heated to a selected bonding or drying temperature as they are advanced but to the rolls 36 as is diagrammatically indicted at 45 in FIG. 1. A cross section through the metal layers 10 and 18 as they are initially brought together in this manner is shown in FIG. 2. The metal layers are then pressed together as they are passed between the bonding rolls 36 for reducing the thickness of the metal layer materials and for metallurgically bonding each of the separable strips 14 to the second metal layer 18 along said second portion 22 of each strip while leaving the strips free of said metallurgical bonds along the first portions 20 of the strips. If desired additional drawing rolls 46 are also rotatably driven in any conventional manner for advancing the metallurgically bonded metal layers 10 and 18 as indicated by the arrow 48 toward conventional cut-off means such as the punch and die means 50 diagrammatically shown in FIG. 1 for cutting off composite metal panels 26 of desired length from the initially bonded metal layers 10 and 18 as will be understood. In one method of the invention, the noted metallurgical bonds are improved by heating the panels to sinter and strengthen the bonds in well known manner and a camming means such as the element diagrammatically illustrated at 52 in FIG. 3 is inserted between the metal layers 10 and 18 in each composite metal panel 26 at the locations of the bond-preventing stripes 16 for breaking the strips 14 apart and for folding the unbonded portions of the strips to form the ribs 14*a*. Preferably for example, the camming means has a tapered, leading entry portion 52.1 to be initially inserted between the metal layers 10 and 18 at the location of a bonding strength 16 and to lift the unbonded portion of the strip 14 away from the layer 18 to break the strips apart at the location of the grooves 12 and has an upright tapered folding portion 52.2 of the camming means which enters the bond-stripe area after the leading entry portion 52.1 for bending or folding the unbonded portion of the strip 14 upright as shown in FIG. 3 to progressively form the ribs 14*a* as the camming means is advanced along each of the noted stripes 16. In that way, the composite metal panel is provided with stiffening ribs 14*a* which are easily and reliably bonded to the metal layer 18 in precisely predetermined locations relative to each other on the layer 18, the ribs being of substantial size. There is no risk of the bond-preventing material of the stripes 16 being undesirably squeezed or forced up between the separable strips 14 of the first metal layer. The strips 14 are easily folded to form the ribs 14*a* and do not require elaborate heat-treating of the ribs after forming for assuring that the ribs display substantial strength properties. The strips are easily separated and folded for forming the ribs without tending to excessively weaken the bonds 24 formed in earlier steps in the method and do not tend to neck down the rib material.

In an exemplary embodiment, the metal layers 10 and 18 are each formed of Aluminum Alloy 6061 having a thickness of about 0.060 inches and the grooves 12 have a depth of about 70% to 85% of that thickness and a width of about 0.040 inches to 0.060 inches and are spaced about 1.5 inches apart center-to-center. The bonding stripes 16 are formed of an epoxy ink or the like as described in the U.S. Pat. No. 4,434,390 or other conventional material and each have a width of about 1.25 inches. The aluminum layer 18 is wire brushed as it is advanced toward the bonding rolls and the stripes 16 are deposited on layer 18 from conventional roll-transfer means as the layer 18 is continuously advanced to the rolls 36. The aluminum layers are heated to a drying temperature of about 150° C. for 1–3 minutes as they are advanced to enter the bonding rolls 36 and are reduced in thickness by about 60% or more as they are passed between the rolls for elongating the layer materials and bond-preventing stripes without significantly widening either the separable strips 14 or the bond-preventing stripes. The composite panels 26 are cut off with a length of about 18 inches. Preferably the bonded panel materials are heated at a temperature of about 350° C. to 400° C. for about 2 hours to improve the bonds. The panels are easily formed with precisely located and securely attached stiffening ribs in a panel of substantial and predetermined strength is provided by the method of this invention.

Figure 4:
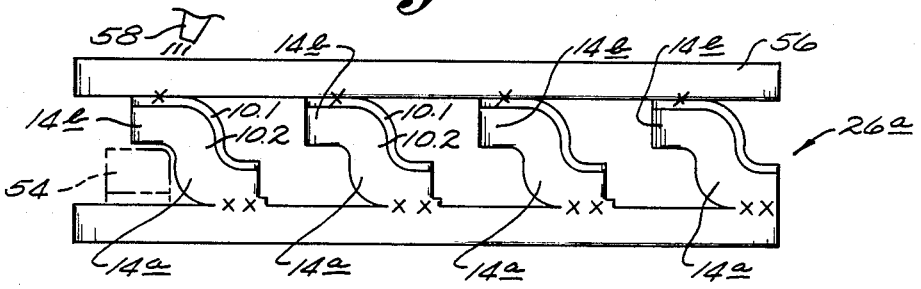
FIG. 4 is an end elevation view of a composite metal panel produced in an alternate preferred embodiment of the method of this invention diagrammatically illustrating steps in that alternate method.

In another alternate embodiment of the invention as illustrated in FIG. 4, in which corresponding components are identified with corresponding reference numerals, the distal edges of the stiffening ribs 14*a* are folded over to form flanges 14*b* by use of forming die means or the like as is diagrammatically illustrated at 54 in FIG. 4. An additional layer of metal 56 is secured to the flanges 14*b* by riveting, epoxying, brazing or in any other conventional manner for providing a two-sided composite metal panel 26*a* as shown in FIG. 4. In one preferred embodiment, the metal layer 10 used in the composite metal panel 26*a* embodies a composite metal laminate material having a layer 10.1 of a brazing alloy type of aluminum material or the like such as silicon-bearing aluminum alloy having a nominal composition by weight of about 11.0% silicon balance aluminum metallurgically bonded to a layer 10.2 of a base metal aluminum material such as Aluminum Alloy 6061. The flanges 14*b* are then bent so that the brazing alloy layer 10.1 is disposed on the outwardly facing surfaces of the flanges as shown in FIG. 4. That brazing alloy material is then utilized for brazing the additional metal layer to the flanges as is diagrammatically illustrated by the brazing torch 58 in FIG. 4.

If desired, the ribs 14*a* provided in the composite panel 26*a* are disposed at angles of 90° C. relative to the second metal layer 18 to provide high strength. However, pairs of the ribs are also oriented at more than and less than 90° C. respectively so that the pairs result in a truss-panel type of configuration as will be understood. Further the ribs can be U or channel shaped rather than Z shaped as shown. And if desired ribs can be arranged to extend from an opposite side of metal layer 18 to support another additional outer panel (not shown) on flanges of those additional but opposite ribs within the scope of this invention.

Figure 5:
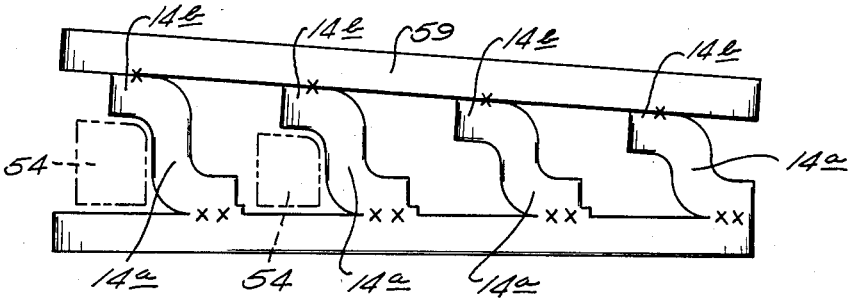
FIG. 5 is an end elevation view of another composite metal panel produced in another alternate embodiment of the method of the invention diagrammatically illustrating a step in that method.

In another alternate embodiment of the method of this invention as shown in FIG. 5, the grooves used in defining the separable strips 14 are spaced progressively closer to each other across the first metal layer used in forming the strips so that the strips have a progressively narrower width from left to right of the composite metal panel 26*b* as viewed in FIG. 5. The strips are then folded up away from the metal layer 18 and the flanges 14*b* are folded over at progressively closer spacing relative to the layer 18 and preferably so that the flanges extend obliquely relative to the layer 18. The additional metal layer 59 is attached to the flanges 14*b* by brazing or the like to extend obliquely relative to the metal layer 18 as shown in FIG. 5.

Figure 6:
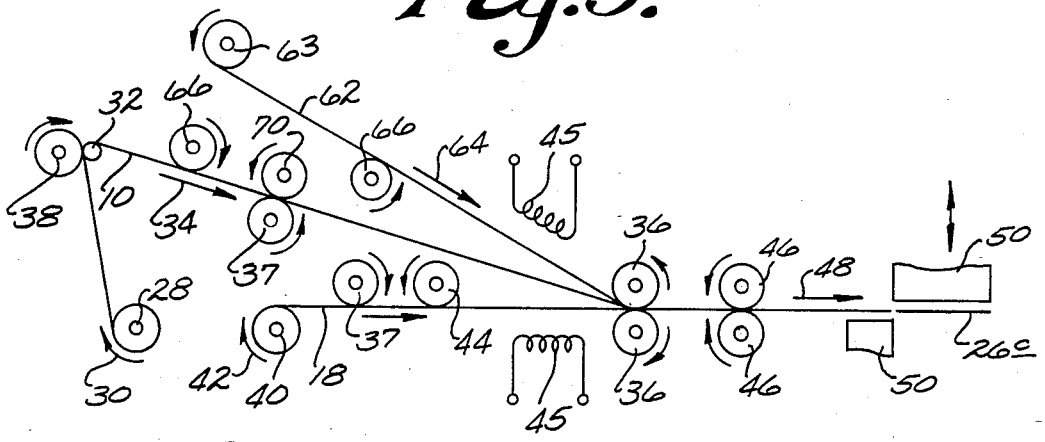
FIG. 6 is a schematic side elevation view similar to FIG. 1 illustrating another preferred embodiment of the method of this invention.
Figure 7:
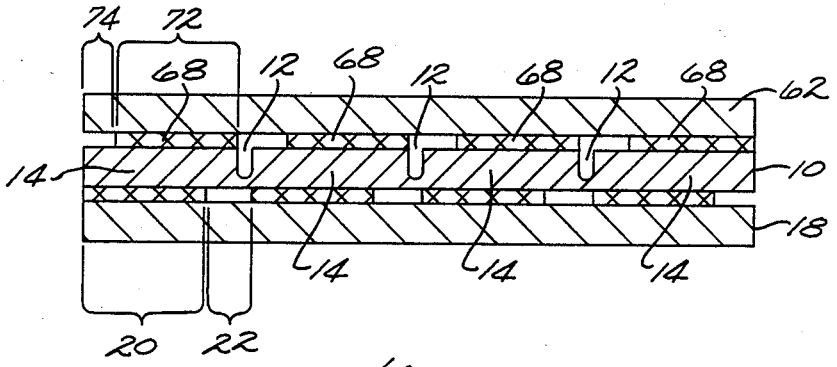
FIG. 7 is a schematic section view through metal layers utilized in the method of FIG. 6 as the metal layers are initially brought together in a step of that method.

In another alternate embodiment of the method as illustrated in FIG. 6, the metal layers 10 and 18 are advanced to the pressure bonding rolls 36 as previously described with reference to FIG. 1. A third additional layer of metal 62 is also advanced from a supply reel 63 in the direction of arrow 64 to pass between the rolls 36 with the metal layers 10 and 18. The grooved surface of the metal layer 10 and a facing surface of layer 62 are preferably cleaned by mechanical means such as the wire brushes diagrammatically illustrated at 66 in FIG. 6 and another group of stripes 68 of bond-preventing material are deposited on the grooved metal layer surface as diagrammatically illustrated at 70 in FIG. 6. The strips 68 also extend parallel to the grooves 12 so that a stripe 68 extends between the third metal layer 62 and a selected limited third portion 72 of each of the separable strips 14 of the first metal layer while leaving an area between third metal layer and a fourth portion 74 of each separable strip 14 free of the bond-preventing material. As shown in FIG. 7, which illustrates a section view through the metal layers 10, 18 and 62 as they are initially brought together adjacent the rolls 36, each stripe 68 on one side of a separable strip 14 partially overlaps a stripe 16 on an opposite side of the strip, the stripe 68 extending along the length of the strip 14 adjacent one edge of the strip while the strength 16 extends along the strip length adjacent an opposite edge of the strip.

Figure 8:
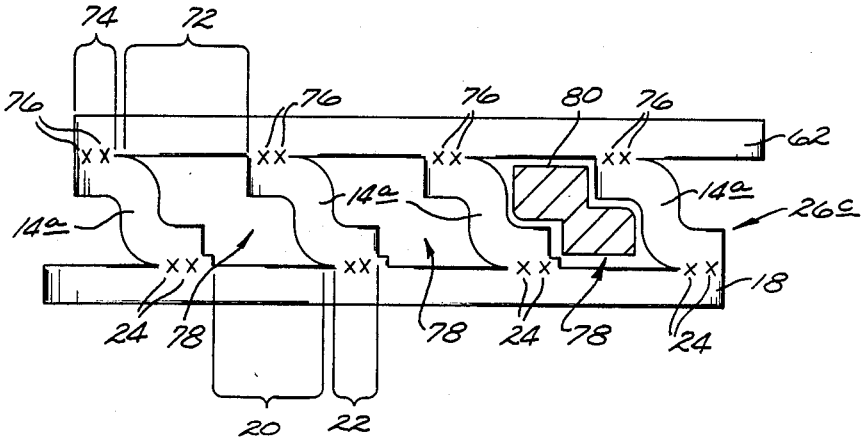
FIG. 8 is an end elevation view of the composite metal panel resulting from the method as illustrated in FIG. 6.

In accordance with this invention, the metal layers 10, 18 and 62 are advanced between the rolls 36 and are pressed together with reduction in the thickness of the layer materials for metallurgically bonding each of the separable strips 14 to the second metal layer 18 as is diagrammatically illustrated at 24 in FIG. 8 and for also metallurgically bonding each of the separable strips 14 to the third metal layer 62 as is diagrammatically indicated at 76 in FIG. 8 for forming a composite metal panel 26*c*. The separable strips 14 in the composite metal panel 26*c* are then broken apart along the grooves 12 and the first unbonded portion 20 of the strips 14 are folded away from the second metal layer 18 as the third unbonded portions 72 of the strips are also folded away from the third metal layer 62.

If desired the separable strips 14 are broken apart in the composite metal panel 26*c* by use of camming means corresponding to the camming means 52 previously described or, if preferred, a pressure nozzle of conventional type is inserted between the metal layer 10 and at least one or preferably two of the other metal layers 18 and 62 and a fluid is introduced between the panel layers under pressure for forcing the separable strips 14 to break apart along the grooves 12 and to lift the metal layers 18 and 62 apart as is diagrammatically illustrated by the arrow 78 in FIG. 8, thereby to form a two-sided composite metal panel 26*c* having ribs 14*a* extending between opposite sides of the panel as is illustrated in FIG. 8. Alternately, if desired, the bond-preventing materials used in forming the bond-preventing stripes 16 and 68 in the panel 26*c* are formed of a material such as described in U.S. Pat. No. 4,434,930 which is heat-decomposable for forming a gas to inflate or separate the layers of the composite metal panel 26*c* and the panel 26*c* is heated after cut-off for decomposing the bond-preventing material to form a gas to break the strips 14 apart and fold them up to form the ribs 14*a*. If desired, rods 80 of steel or other stiffening material are selectively inserted into the composite metal panel 26*c* between one or more of the ribs 14*a* for increasing the panel strength.

It should be noted that although the methods of the invention have been described previously with respect to the use of grooves 12 which extend in parallel relation to each other which is most convenient for carrying out the inventions, the grooves could also be provided in a desired relationship to bond-preventing patterns of other than stripe configuration within the scope of this invention particularly where the grooved metal layer is to be broken into separable strips by inflation or the like, such grooves being preferably provided by computer controlled milling machines or the like as may be desired.

It should be understood that although particular embodiments of the method of this invention have been described in detail by way of illustrating the invention, the invention includes all modifications and equivalence of the disclosed embodiments falling within the scope of the appended claims.

We claim:

1. A method for making a stiffened composite metal panel member comprising the steps of forming a plurality of relatively narrow grooves extending in spaced side-by-side parallel relation to each other in a first layer of metal, the grooves having depths less than the thickness of the first metal layer for defining separable strips of the first metal layer, arranging a plurality of stripes of bond-preventing material in spaced side-by-side parallel relation to each other between the first metal layer and a second layer of metal, the stripes extending parallel to the grooves and having widths and spacings selected relative to the spacing of the grooves so that a stripe of bond-preventing material extends between the second metal layer and a first portion of each of said separable strips of the first metal layer extending along one edge of the strip leaving a second portion of each strip extending along an opposite edge of the strip free of such bond-preventing material, pressing the metal layers together with reduction in thickness thereof for metallurgically bonding said second portions of each of the separable strips to the second metal layer to form a composite metal panel while leaving said first portions of each separable strip free of such bonds, separating said separable strips of the first metal layer from each other along the grooves and bending said first strip portions away from the second metal layer to form precisely located stiffening ribs in the composite metal panel, folding a distal edge of each of the stiffening ribs for forming a flange along said distal edge, and securing a third layer of metal to said flanges.

2. A method as set forth in claim 1 wherein the stiffening ribs are folded for forming said flanges at progressively smaller spacings from the second metal layer progressing from one edge to the other of the second metal layer, and the third metal layer is secured to said flanges to extend obliquely relative to said second metal layer.

3. A method as set forth in claim 1 wherein said first metal layer comprises a composite metal laminate material having a surface layer of a brazing alloy material metallurgically bonded to a layer of base metal material, the metal layers are pressed together for forming said metallurgical bonds between the second metal layers and a selected side of the first metal layer, the stiffening ribs are folded in forming said flanges for disposing said brazing alloy material on surfaces of said flanges facing away from said second metal layer, and the third metal layer is brazed to said flange surfaces using said brazing alloy material.

* * * * *